US011927414B2

(12) United States Patent
Mirzoev

(10) Patent No.: US 11,927,414 B2
(45) Date of Patent: Mar. 12, 2024

(54) LONGITUDINALLY SLIDING BOLT OF SMALL ARMS WITH A COLLET CLUTCH MECHANISM ON THE BARREL

(71) Applicant: Rustam Gashimovich Mirzoev, pgt Sunzha (RU)

(72) Inventor: Rustam Gashimovich Mirzoev, pgt Sunzha (RU)

( * ) Notice: Subject to any disclaimer, the term of this patent is extended or adjusted under 35 U.S.C. 154(b) by 0 days.

(21) Appl. No.: 17/917,299

(22) PCT Filed: May 8, 2022

(86) PCT No.: PCT/RU2022/050147
§ 371 (c)(1),
(2) Date: Oct. 6, 2022

(87) PCT Pub. No.: WO2023/282792
PCT Pub. Date: Jan. 12, 2013

(65) Prior Publication Data

US 2023/0375293 A1 Nov. 23, 2023

(30) Foreign Application Priority Data

Jul. 6, 2021 (RU) ..... 2021119733

(51) Int. Cl.
*F41A 3/40* (2006.01)

(52) U.S. Cl.
CPC ..... *F41A 3/40* (2013.01)

(58) Field of Classification Search
CPC ..... F41A 3/40; F41A 3/38
See application file for complete search history.

(56) References Cited

U.S. PATENT DOCUMENTS 3,793,922 A * 2/1974 Angell ..... F41A 3/36
42/76.01
4,227,439 A * 10/1980 Gillum ..... F41A 3/70
89/190

* cited by examiner

*Primary Examiner* — J. Woodrow Eldred
(74) *Attorney, Agent, or Firm* — Nadya Reingand

(57) ABSTRACT

The invention relates to locking mechanisms for arms-grade bolts, in particular to locking mechanisms for longitudinally sliding bolts. The technical result is achieved by that a longitudinally sliding bolt of small arms with a collet clutching mechanism on a barrel comprises collet clutching petals, a sleeve-like element controlling the collet clutching petals, a striker, a striker spring, and a bolt spring having a stop. The collet clutching petals are arranged on top of a bolt body and framed by an inertial sleeve having a spacer spring. Furthermore, the collet clutching petals are fastened with a circular spring shifted to the front side of the bolt and have protrusions at both ends which extend away from a bolt axis. The spacer spring and the inertial sleeve configured to longitudinally slide along the collet clutching petals are arranged between the protrusions sequentially in a row away from the end of the bolt.

5 Claims, 5 Drawing Sheets

LONGITUDINALLY SLIDING BOLT OF SMALL ARMS WITH A COLLET CLUTCH MECHANISM ON THE BARREL

FIELD OF THE INVENTION

The invention relates to locking mechanisms for arms-grade bolts, in particular to locking mechanisms for longitudinally sliding bolts.

BACKGROUND OF THE INVENTION

Longitudinally sliding bolts are currently commonly used in small arms due to their proven manufacturing technology and reliable locking. However, these bolts also have disadvantages: one of the main disadvantages is the need for two movements, longitudinal and transverse, which leads to a low rate of fire and difficulty in firing a shot in conditions of lack of time.

Thus, one of the urgent tasks of small arms having longitudinally sliding bolts is to simplify the reloading of the small arms, namely, provide one-movement reloading, i.e., without turning the bolt, as well as to provide the possibility of conducting semi-automatic and automatic fire without compromising the reliability of bolt-to-barrel clutching and the possibility of using higher-yield cartridges. One of the ways to solve these problems is to clutch the bolt to the barrel in a collet type. These solutions suffer from the following disadvantages: unsatisfactory bolt-to-barrel clutching and the impossibility of using powerful high-yield charges.

The technical solution closest to the claimed invention in terms of a set of essential features consists in clutching the bolt to the barrel using a collet mechanism, with a sliding sleeve arranged inside the bolt being used as a control element. The main disadvantages of this solution are as follows: the impossibility of maintaining semi-automatic and automatic fire; the need to lock the bolt at a certain speed and a certain force, otherwise collet fixation will not work; high complexity and required manufacturing accuracy, which leads to high cost.

The technical solution closest to the claimed invention in terms of a set of essential features consists in clutching the bolt to the barrel using a collet mechanism, with a sliding sleeve arranged inside the bolt being used as a control element (see Blaser R8 carbine, "Why has the bolt changed?/section "New bolt"/[Electronic resource]—URL: https://alivewater.ru/katalog/apparaty-pitevoj-vody (accessed on 4 Jun. 2021)). The main disadvantages of this solution are as follows: the impossibility of maintaining semi-automatic and automatic fire; the need to lock the bolt at a certain speed and a certain force, otherwise collet fixation will not work; high complexity and required manufacturing accuracy, which leads to high cost.

SUMMARY OF THE INVENTION

The problem to be solved by the claimed invention is to expand the arsenal of technical means for the following purposes: a longitudinally sliding bolt of small arms with a collet clutching mechanism on a barrel.

The above-indicated technical result of the claimed invention is achieved by that the longitudinally sliding bolt of the small arms with the collet clutching mechanism on the barrel comprises collet clutching petals, a sleeve-like element controlling the collet clutching petals, a striker, a striker spring, and a bolt spring having a stop.

At the same time, the collet clutching petals are arranged on top of a bolt body and framed by an inertial sleeve having a spacer spring. The collet clutching petals are provided in an amount of at least two, fastened with a circular spring shifted to the front side of the bolt from the central part of the collet clutching petals, and have protrusions at both ends which extend away from a bolt axis. The spacer spring and the inertial sleeve configured to longitudinally slide along the collet clutching petals are arranged between the protrusions sequentially in a row away from the end of the bolt.

Furthermore, protrusions extending inwardly to engage with the barrel are provided on the inner side of the collet clutching petals towards the bolt axis in the front part of the collet clutching petals. In the central part of the collet clutching petals, there are swing stops providing a lever-type mechanism for clutching and declutching the bolt to and from the barrel. There are protrusions for fixing the collet clutching petals on the bolt, which are arranged between the swing stops closer to the front part of the collet clutching petals.

The outer surface of the collet clutching petals has a longitudinal protrusion having gradual bevels and shifted to the rear side of the bolt. The longitudinal protrusion is configured to control the mechanism for clutching and declutching the collet clutching petals on the barrel.

The longitudinal protrusion on the rear side of the bolt has a ledge configured to temporarily fix the inertial sleeve in a rear position until the front part of the bolt comes into contact with a breech piece of the barrel when the bolt moves forward. At the same time, matching elements for fixing both the swing stops and the protrusions for fixing the collet clutching petals are provided on the surface of the bolt.

Similar to the above-indicated closest technical solution, the claimed invention has the following essential features: the collet clutching petals, the sleeve-like element for controlling the collet clutching petals, the striker, the striker spring, and the bolt spring with the stop.

The claimed invention differs from the above-indicated closest technical solution by the following essential features:

- the collet clutching petals are arranged on top of the bolt body and framed by the inertial sleeve with the spacer spring;
- the collet clutching petals are provided in an amount of at least two;
- the collet clutching petals are fastened with the circular spring shifted to the front side of the bolt from the central part of the collet clutching petals;
- the collet clutching petals are provided with the protrusions at both ends, which extend away from the bolt axis, and the spacer spring and the inertial sleeve configured to longitudinally slide along the collet clutching petals are arranged between the protrusions sequentially in a row away from the end of the bolt;
- the protrusions extending inwardly to engage with the barrel are provided on the inner side of the collet clutching petals towards the bolt axis in the front part of the collet clutching petals; the swing stops are provided in the central part of the collet clutching petals, which provide the lever-type mechanism for clutching and declutching the bolt to and from the barrel; and the protrusions for fixing the collet clutching petals on the bolt are provided between the swing stops closer to the front part of the collet clutching petals;
- the outer surface of the collet clutching petals is provided with the longitudinal protrusion having gradual bevels and shifted to the rear side of the bolt, the longitudinal protrusion being configured to control the mechanism for clutching and declutching the collet clutching petals on the barrel;

the longitudinal protrusion on the rear side of the bolt is provided with the ledge configured to temporarily fix the inertial sleeve in the rear position until the front part of the bolt comes into contact with the breech piece of the barrel when the bolt moves forward;

the matching elements for fixing both the swing stops and the protrusions for fixing the collet clutching petals are provided on the surface of the bolt.

The above-indicated essential features are distinctive because each of them is not contained in the set of essential features of the closest technical solution, i.e., is not present in the list of features implemented in the closest technical solution and is not their characteristic.

For an unambiguous and more complete understanding of the description of the claimed invention, the following are explanations and clarifications of the concepts and terms used above, as well as disclosure of the features of the invention, indicating the cause-and-effect relationships of their implementation.

The main inventive idea of the claimed technical solution is to implement the clutching of the bolt to the barrel using the collet mechanism, as well as to control the mechanism of said clutching with the aid of the inertial sleeve sliding along the profile surface defining the spatial position of the ends of the collet clutching petals. This idea is technically implemented in the manner described below.

A bolt-to-barrel clutching element is represented by the collet clutching petals configured to grip the barrel, clutch to the barrel, as well as to implement the bolt clutching-declutching mechanism itself. The number of the collet clutching petals should be at least 2; the mechanism cannot be implemented with a smaller number of the collet clutching petals. In practice, the maximum number of the collet clutching petals can reach 24; with a larger number of the collet clutching petals, the clutching force will weaken in case of any misalignment of the bolt or its parts. The collet clutching petals are named by analogy with the petals of a collet (collet clamp), since they have the same purpose and a similar design. The collet clutching petals are arranged on top of the bolt with a gap therebetween and are connected to the outer surface of the bolt at one point by means of a protrusion on the inner part of the collet clutching petal which is directed towards the surface of the bolt. At the same time, this protrusion is a swing stop, by which the ends of the collet clutching petals are displaced along the radius from the bolt axis, thereby implementing the clutching-declutching mechanism according to the lever principle. This mechanism can also be referred to as "two-lever". The protrusion is provided in the central part of the collet clutching petal so that the collet clutching petal can perform the swing function. Thus, this relates to a loose coupling, for example, a protrusion stop in the recess of the surface of the bolt, pin-aided engagement on special protrusions of the surface of the bolt, or a stop between such special protrusions. The location of the protrusion, its height and the gap between the collet clutching petals and the surface of the bolt define the amount of deviation of the ends of the collet clutching petals from the surfaces of the bolt and barrel, respectively. In other words, the collet clutching petals clutching and declutching the bolt to and from the breech piece of the barrel are a lever-type swinging grip having a swing point on the bolt body.

To implement the clutching-declutching function, at least 2 protrusions extending inwardly to engage with the barrel are provided on the inner side of the collet clutching petals towards the bolt axis in the front part of the collet clutching petals. The front side of the collet clutching petals is called "the side facing the barrel", while the opposite side of the collet clutching petals is called "back". The protrusions are made one by one such that one of them is arranged at the very beginning of the collet clutching petal and is configured to engage with the barrel, and the second (and others, if any) is indented from the edge and is configured to engage with the bolt. All the collet clutching petals are fastened with the circular spring framing them along their outer surface and recessed into their outer surface. The location of the fastening of this spring is shifted away from the central part of the collet clutching petals towards their front part. The purpose of the circular spring is to shift the front arm of the collet clutching petals to the bolt axis when implementing the clutching mechanism, as well as to align the position of the collet clutching petals along the circumference.

The collet clutching petals are framed by the inertial sleeve provided with the spacer spring. The spacer spring is a helical compression spring. To stop the spring and limit the movement of the inertial sleeve on the outer side of the collet clutching petal along its edges, the protrusions are made outward, which are thus restrictive. The longitudinal protrusion having gradual bevels in both directions is provided on the outer side of the collet clutching petals, shifted in its position to the rear side of the collet clutching petals (bolt) and configured to control the mechanism for clutching and declutching the collet clutching petals on the barrel. The mechanism is controlled by moving the inertial sleeve along the outer surface of the collet clutching petals. When viewed in the section passing through its axis, the inertial sleeve has a U-shaped configuration with a crossbar facing away from the axis. In other words, on the inner side of the sleeve facing the collet clutching petals, there is a circular groove, recess or slot along the central part of the entire inner circumference, so that a flanging or flanging ledges directed towards the surface of the collet clutching petals are formed on both sides of the circular groove, recess or slot. The interaction of both ledges with the outer surface of the collet clutching petals, on which the longitudinal protrusion with the gradual bevels is made, makes it possible to implement the above-indicated clutching-declutching mechanism: when the sleeve moves towards the rear part of the bolt, the front parts of the collet clutching petals move apart, thereby releasing the bolt, whereupon the bolt moves back. When the bolt and sleeve return, the reverse process occurs—the front parts of the collet clutching petals are compressed and the bolt clutches to the barrel. This clutching-declutching control is performed by implementing a lever-type (two-lever) control scheme with one fulcrum. In this case, the inertial sleeve acts as a controller, moving along the surface of the collet clutching petals and resting with the flanging ledges against predefined points of the longitudinal protrusion.

The longitudinal protrusion with the smooth bevels on its back side, i.e., on the side of the rear part of the bolt, has a ledge configured to temporarily fix the inertial sleeve in the rear position until the front part of the bolt comes into contact with the breech piece of the barrel when the bolt moves forward. In this case, there is a moment of expansion of the front part of the collet clutching petals on the protrusions of the breech piece of the barrel (i.e., the outer protrusions of the barrel), at which the rear parts of the collet clutching petals are respectively compressed, thereby releasing the inertial sleeve. After that, the sleeve moves forward and secures the clutching of the bolt to the barrel.

The collet clutching petals may also be additionally interconnected to avoid their displacement. This interconnection may be made, for example, with arch wires. To avoid the displacement, it is also possible to make a guiding relief, for example, grooves, on the surface of the bolt.

The manufacturing materials of the system parts are mainly structural steels of various grades. In this case, the manufacturing materials of the inertial sleeve should be heavy metal alloys, for example, tungsten-containing alloys.

The claimed invention is a technical solution, because it solves the problem of achieving the claimed technical result by creating a structural system, namely, the longitudinally sliding bolt of small arms, i.e., a device comprising structural elements which are technologically and structurally interconnected. At the same time, the set of essential features of the invention—the set of devices and structural elements—is united by a single inventive concept—the implementation of bolt-to-barrel clutching using the collet mechanism and its control. The device parts (elements) are in structural unity and functional relationship, and their joint use leads to the creation of a new device that ensures the achievement of the claimed technical result, namely, the implementation of the stated purpose.

This technical solution is industrially applicable in the field of locking mechanisms for longitudinally sliding bolts. The application and use of such mechanisms do not cause any difficulties and can be carried out by skilled artisans. When implementing the invention, devices, apparatuses and materials are used, which are industrially produced and are freely available for sale. Methods for implementing the invention are as follows: casting, rolling, stamping, turning and milling, laser cutting, assembly. Implementation means are metal-working machines and assembly.

The above-given description shows that the implementation of the distinctive essential features, including their characteristics, ensures the achievement of the claimed technical result when using other essential features of the invention which are indicated in the description, namely, ensures the implementation of the purpose of the invention.

Thus, it is shown that the set of essential features of the claimed invention, which makes it possible to achieve the claimed technical result, differs from the set of essential features of the analogues, the closest technical solution, as well as other known data sources, i.e., the application of this set of essential features with the implementation of the stated purpose or with the achievement of the claimed technical result is unknown from the prior art. In other words, the claimed invention is unknown from the prior art.

While studying the longitudinally sliding bolts of small arms with the collet clutching mechanism on the barrel in the prior art, no technical solution has been revealed, the essential features of which, individually or in any combination, coincide with the distinctive essential features of the claimed invention and allow achieving the claimed technical result. Thus, the lack of knowledge from the prior art about the influence of the distinctive essential features of the claimed invention on the claimed technical result, in this case on the implementation of the purpose of the invention, is confirmed.

It should also be noted that the use of the entire claimed set of essential features, including the set of distinctive features, to obtain the claimed technical result is not obvious for skilled artisans from the prior art, since it is not a combination, change or sharing of information contained in the prior art, and/or general knowledge of a skilled artisan.

An increase in the efficiency of the claimed technical result is achieved in the following modifications of the proposed system, which include:

- the longitudinally sliding bolt of small arms has 2-24 collet clutching petals;
- the inertial sleeve has a U-shaped configuration, when viewed in the section passing through its axis.
- the spacer spring is a helical compression spring.
- the protrusions for fixing the collet clutching petals on the bolt are provided in an amount of 1-3 pieces on the inner side of each collet clutching petal.

The above-indicated modifications of the claimed invention are technical solutions, since they represent private solutions to the problem of achieving the claimed technical result by implementing the longitudinally sliding bolt of small arms comprising structural elements which are technologically and structurally interconnected. At the same time, the set of essential features of the invention—the set of devices and structural elements—is united by a single inventive concept. The device parts (elements) are in a constructive unity and functional relationship.

The above-indicated modifications of the claimed method are industrially applicable, since they can be applied in the field of locking mechanisms for the longitudinally sliding bolts of small arms with the collet clutching mechanism on the barrel. The application and use of such mechanisms do not cause any difficulties and can be carried out by skilled artisans. When implementing the invention, devices, apparatuses and materials are used, which are industrially produced and are freely available for sale. Methods for implementing the invention are as follows: casting, rolling, stamping, turning and milling, laser cutting, assembly. Implementation means are metal-workings machines and assembly.

BRIEF DESCRIPTION OF THE DRAWINGS

The description of the claimed invention "Longitudinally sliding bolt of small arms with a collet clutching mechanism on a barrel" is explained by the following diagrams:

Figure 1:
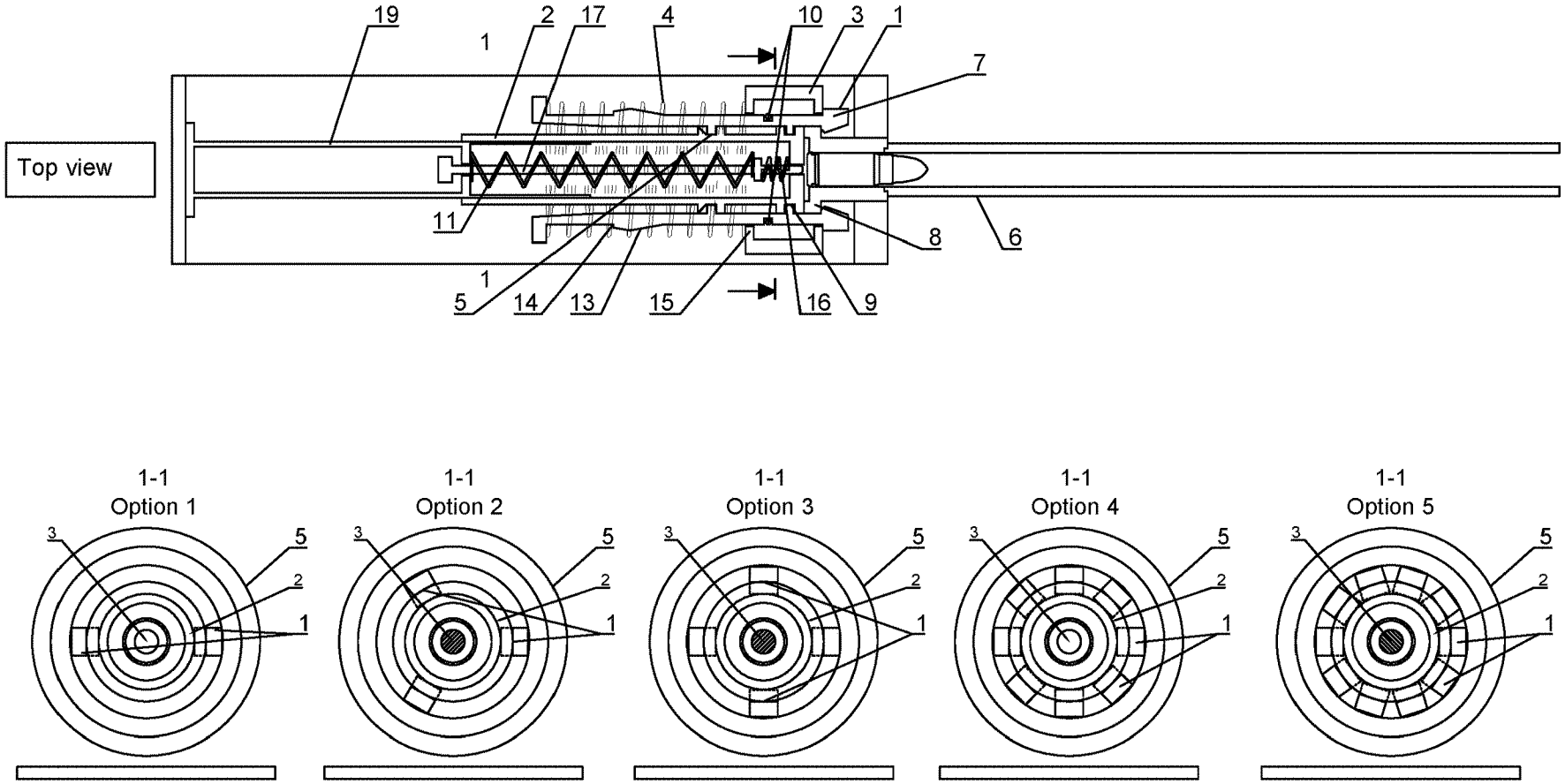
FIG. 1 shows a general sectional top view of a longitudinally sliding bolt of small arms with a collet clutching mechanism on a barrel in an initial pre-firing position.

The following reference signs are given in the figures:

1. Collet clutching petal

2. Bolt

3. Inertial sleeve

4. Spacer spring
5. Swing stop
6. Barrel
7. Protrusion for clutching to the barrel
8. External protrusion of the barrel
9. Protrusion for engaging the petal with the bolt
10. Circular spring
11. Bolt spring
12. Restrictive protrusion
13. Longitudinal protrusion with gradual bevels
14. Temporary-fixation ledge for the inertial sleeve
15. Flanging ledge of the inertial sleeve
16. Striker spring
17. Striker
18. Trigger with a hammer
19. Fixed stop

DETAILED DESCRIPTION OF THE INVENTION

In the claimed invention, the main task is solved with the aid of grips which are collet petals 1 arranged on top of a bolt body 1 and framed by an inertial sleeve 3 having a spacer spring 4. Depending on the tasks and power of the ammunition, the number of the collet petals can vary from 2 to 24. The collet petals are made with a gap from the surface of the bolt body, which provides a swing stop 5 protruding from the inner surface of the petal towards the bolt and arranged in the central part of the petal. The swing stop also performs the function of clutching and declutching the bolt to and from a barrel 6 by implementing a lever-type mechanism for clutching and declutching the bolt to and from the barrel 6, by which the ends of the collet petals are moved relative to a bolt axis. The swing function is provided by the loose clutching of the swing stop, for example, a protrusion stop in the recess of a bolt surface, pin-aided engagement on special protrusions of the bolt surface or a stop between such special protrusions. The actual bolt-to-barrel clutching is performed by protrusions made on the inner side of the petals from the side of the barrel and directed towards the bolt axis. One of these protrusions is extreme and arranged at the very end of a petal 7. This protrusion is responsible for clutching to the barrel due to engagement with an outer protrusion 8 of the barrel. Another protrusion 9 is indented from the extreme protrusion and serves to fasten the petal to the bolt. Thus, the bolt is clutched to the barrel by means of a rigid external structural element. In this case, it should be considered that there may be several, for example, 2 or 3, protrusions like the protrusion 9 to increase the clutching strength. All the collet petals are fastened with a circular spring 10 shifted to the front side of the bolt from their central part; the purpose of the spring is to shift the front arm of the petals towards the bolt axis. The mounting location of this spring is shifted away from the central part towards the front part. The bolt is automatically clutched to and declutched from the barrel by means of a mechanism implemented when the bolt moves back due to recoil and forward when exposed to a helical spring 11 of the bolt. This mechanism is implemented by: providing the inertial sleeve and the spacer spring around (i.e., framing) the collet petals; providing restrictive protrusions 12 extending away from the bolt axis at both ends of each petal on the outer side of the petal; providing a longitudinal protrusion 13 having gradual bevels and shifted to the rear side of the bolt on the outer side of the petal; and providing a ledge on the back side of the longitudinal protrusion for temporarily fixing the inertial sleeve. As seen in the section perpendicular to its axis, the inertial sleeve has a U-shaped configuration directed by a crossbar away from the bolt axis. In other words, on the inner side of the sleeve facing the petals, it has a circular groove or slot along the entire central part, so that a flange or flange ledges 15 directed towards the surface of the petals are formed on both sides of the circular groove or slot. The interaction of both ledges with the outer surface of the petals, on which the longitudinal protrusion with the gradual bevels is made, allows the clutching-declutching mechanism to be implemented: when the sleeve moves towards the rear part of the petal, the front parts of the petals move apart, thereby releasing the bolt, whereupon the bolt moves back. When the bolt and sleeve return, the reverse process occurs—the front parts of the petals are compressed, and the bolt clutches to the barrel.

The external structural elements (features) that ensure the operation of the bolt are as follows: a helical spring 16 of a striker, the striker 17, a trigger 18 with a hammer, and a fixed stop 19.

The bolt operates as follows.

Figure 2:
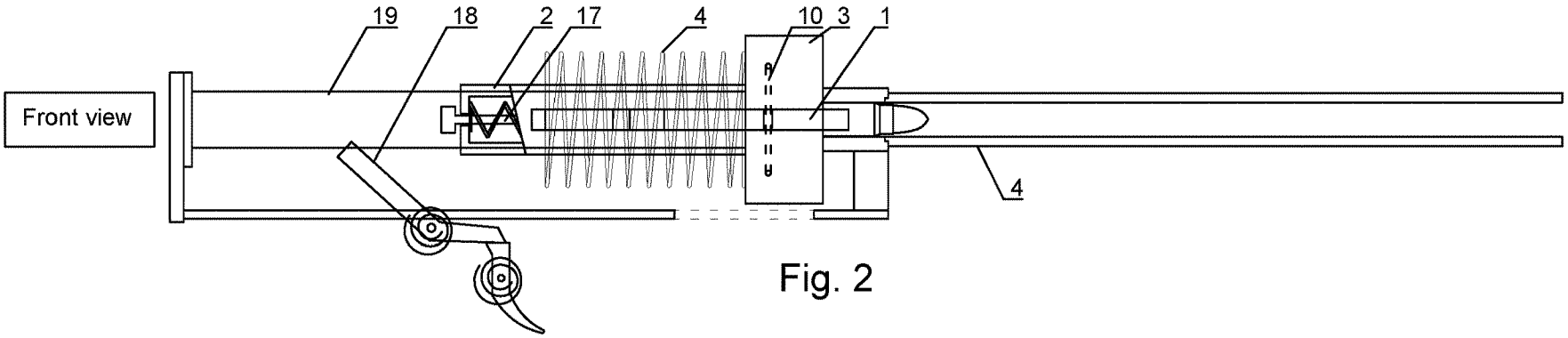
FIG. 2 shows a general side view of the bolt.

In the initial position, a cartridge is in a cartridge chamber, the bolt is in the position in which it is clutched to the barrel (FIG. 1, FIG. 2) fixed by the barrel clutching protrusion for the outer protrusion of the barrel, the inertial sleeve takes the extreme position at the barrel clutching protrusion, the spacer spring and the bolt spring are in an unstressed state, and the striker is in its initial position with an unstressed spring.

Figure 3:
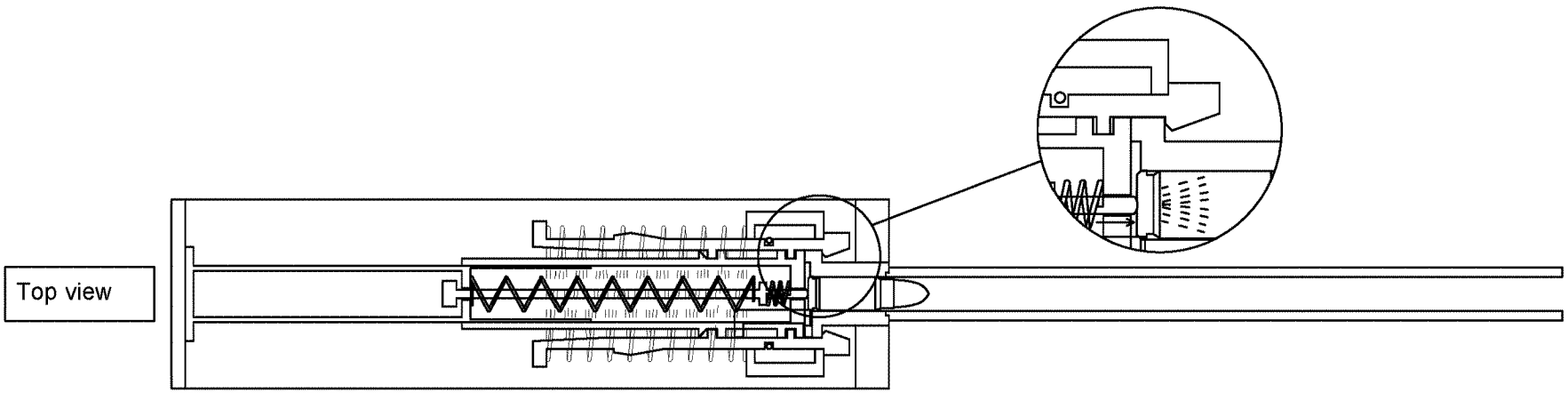
FIG. 3 shows a top view of the bolt in a shot start position.
Figure 4:
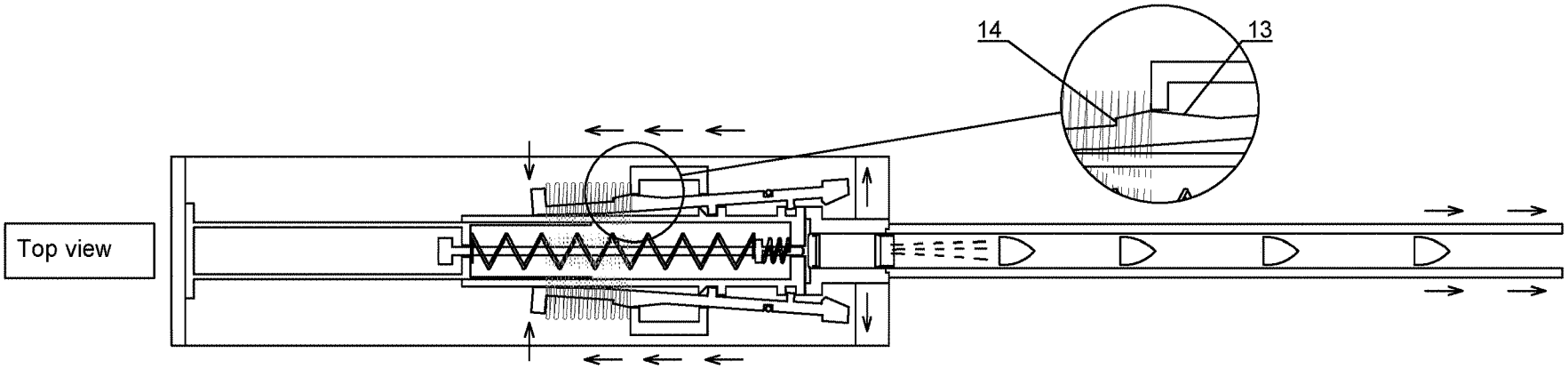
FIG. 4 shows a view of the bolt in the position when an inertial sleeve is temporarily fixed and a cartridge case is extracted.
Figure 5:
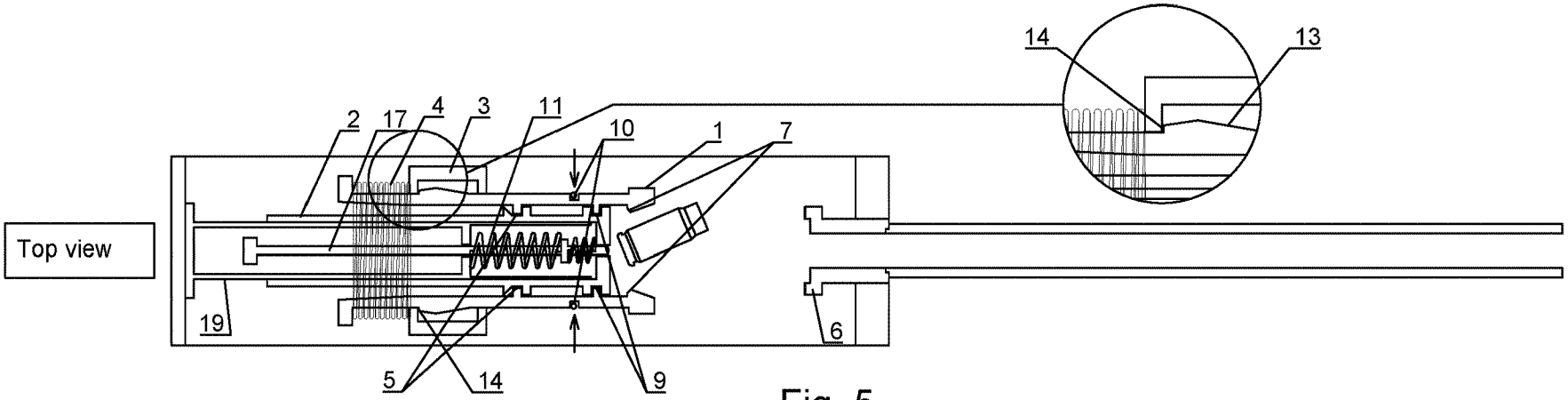
FIG. 5 shows a top view of the bolt in the position when the inertial sleeve starts to move reversely.
Figure 6:
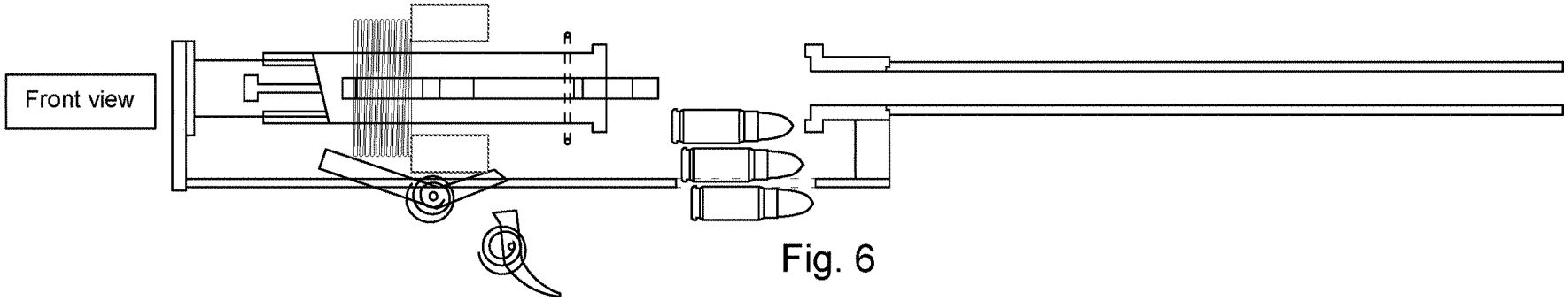
FIG. 6 shows a side view of the bolt in a bolt-to-barrel clutching position.

A shot is carried out by pressing the trigger, whereupon the trigger hits the striker, thereby leading to the ignition of the powder charge of the cartridge (FIG. 3). After the shot, the striker spring returns it to its original position. As a result of the shot, due to recoil, the inertial sleeve moves away from the barrel, while compressing the spacer spring (FIG. 4). The movement of the sleeve continues until it engages with the temporary-fixation ledge (FIG. 5, FIG. 6). When the sleeve moves to this ledge, the bolt is declutched from the barrel due to the lifting of the ends of the petals with the fixation protrusions because of the implementation of the lever-type mechanism on the swing stops (FIG. 4). Such a mechanism is implemented by the ledges of the flanging of the inertial sleeve when they rest against predefined points on the outer surface of the longitudinal protrusion of the petals. After the bolt is declutched from the barrel, it also moves away from the barrel, while compressing the bolt spring. The movement of the bolt continues until it collides with the fixed stop. During this movement, the bolt spring is compressed. When the bolt moves away from the barrel, a cartridge case is extracted.

Figure 7:
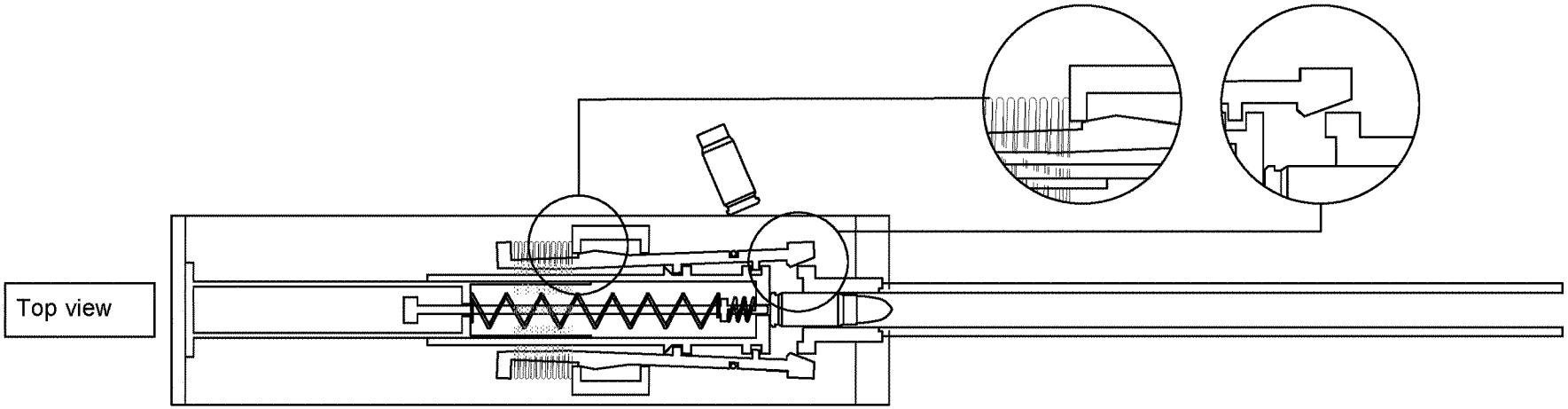
FIG. 7 shows a top view of the bolt in the position when collet clutching petals are released from a temporary-fixation ledge and move along a longitudinal protrusion having gradual bevels.
Figure 8:
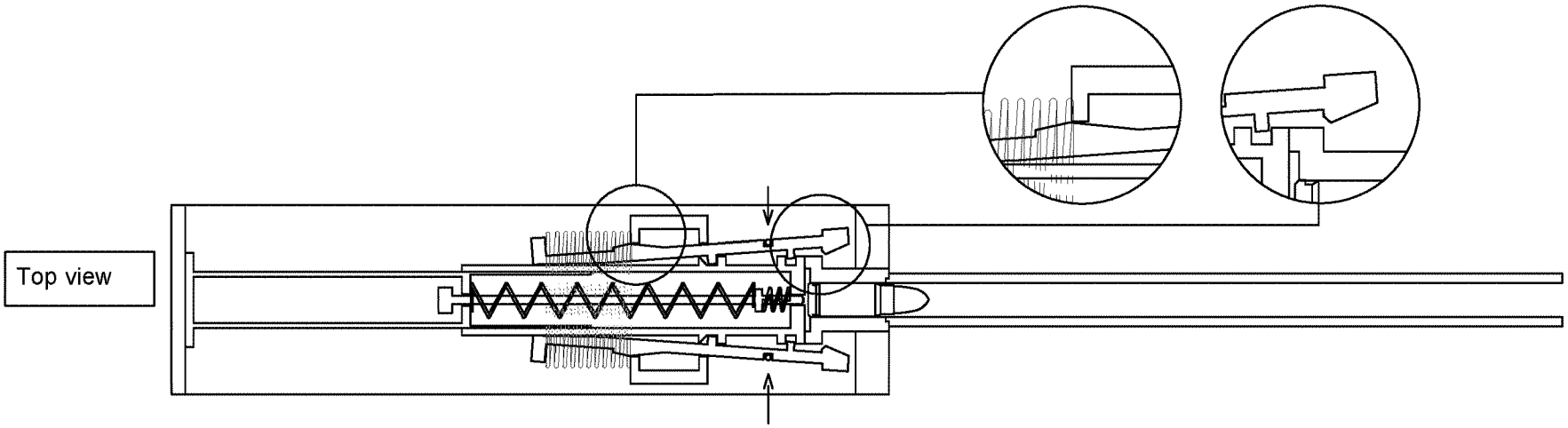
FIG. 8 shows a top view of the bolt in the position when the ends of the petals with fixation protrusions move apart and overcome outer protrusions of the barrel.
Figure 9:
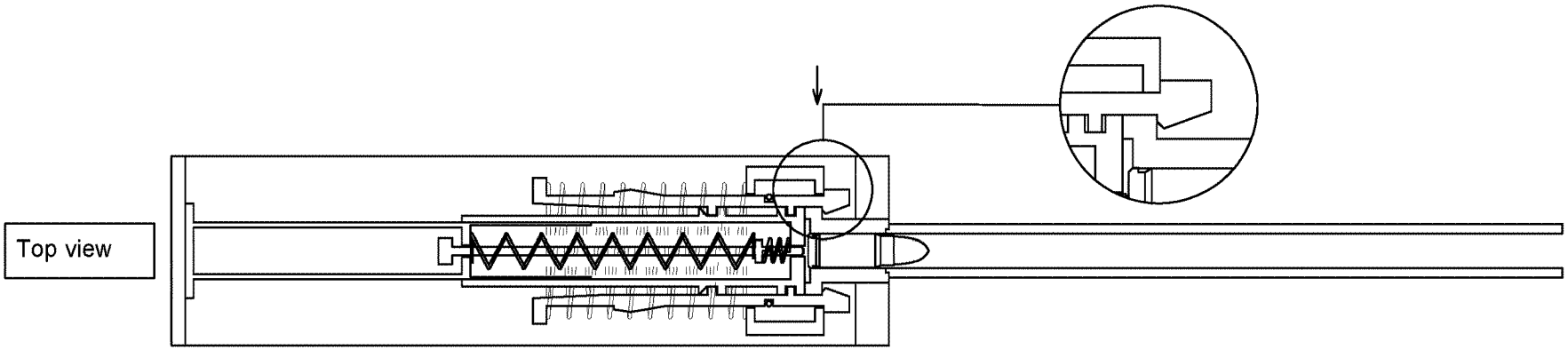
FIG. 9 shows a top view of the bolt in the bolt-to-barrel clutching position provided by the engagement of clutching protrusions at the end of the petals of the outer protrusion of the barrel.

After the bolt reaches the fixed stop, its inertia force is extinguished, and it begins to move back to the barrel under the action of the compressed bolt spring. When the bolt moves forward, the barrel is loaded with a cartridge. At the same time, the inertial sleeve is released from the temporary-fixation ledges by lowering the rear ends of the collet petals to the bolt axis and begins to move towards the barrel clutching protrusions (FIG. 7). Once the inertial sleeve is released from the temporary-fixation ledge, the inertial sleeve abuts with its released ledge (the ledge of the inertial sleeve on the rear side) against the longitudinal protrusion of the petals, which causes the ends of the petals with the fixation protrusions to move apart, thereby allowing the petals to overcome the outer protrusions of the barrel (FIG. 8) and, finally, when the extreme position is reached due to the action of the spacer spring, to securely clutch the bolt to the barrel as a result of the tight wrapping of the petals (FIG. 9). Thus, the bolt is again brought into combat position.

The maintainability of the bolt is determined by the ease of its implementation. To do this, the bolt and, accordingly, the collet petals are brought into the rear position. Then, without moving the bolt forward, the collet petals are brought into the extreme forward position, whereupon the rear part of the spacer spring is pressed forward and pushed beyond the swing stops of the petals, the back part of the petals is moved apart, and the inertial sleeve is removed forward.

By implementing the longitudinally sliding bolt of small arms with the collet clutching mechanism on the barrel, it is possible to obtain the following useful qualities:

1. The design of the bolt allows reloading the small arms only due to the longitudinal stroke of the bolt, without having to turn it. This allows a shooter to avoid making additional movements of the bolt, simplifies the design, and improves its reliability.

2. The proposed design can be used for all types of reloading, such as manual reloading, semi-automatic firing and automatic firing. The design can also be used both for shooting from rifled weapons, and when firing from smooth-bore weapons.

3. In the proposed design, powder gases are not used for the reloading mechanism, for which reason a powder residue does not penetrate the reloading mechanism and the bolt mechanism, thereby leading to the following: firstly, there is no contamination of the mechanisms, and secondly, there is no heating and overheating of the parts and the mechanisms. All of this results in more reliable and durable operation of the small arms. Furthermore, the absence of a gas outlet provides a more stable movement of a bullet in the barrel, thereby improving the accuracy of fire.

4. In the proposed design, the bolt and the barrel are fixed to each other practically without the participation of a barrel receiver, the presence of which is not necessary in this system. Thus, after locking the barrel with the bolt, and during the firing, the entire load is distributed between the barrel and the bolt, for which reason the weight of the small arms, its reliability and durability are significantly improved.

5. The claimed design allows for a quick replacement of the barrel for different types of ammunition, which makes the small arms universal for various applications.

Example 1

In the initial position, after the bolt is cocked, its position is described as follows: the cartridge is in the cartridge chamber, the bolt is in the position when it is clutched to the barrel (FIG. 1) fixed by the barrel clutching protrusion for the outer protrusion of the barrel, the inertial sleeve takes the extreme position at the barrel clutching protrusion, the spacer spring and the bolt spring are in an unstressed state, the striker is in its original position with the unstressed spring. The number of the collet petals arranged on top of the bolt body and framed by the inertial sleeve with the spacer spring is 2. On the inner side of these petals, there are projections for their fixation on the bolt in the amount of one per each petal. These protrusions are arranged between the swing stop and the barrel clutching protrusion, closer to the latter.

A shot is carried out by pressing the trigger, the trigger hits the striker, the striker pierces a cartridge primer, a powder charge in the cartridge case ignites, the striker spring returns the striker to its original state, a bullet flies out of the barrel, and a recoil force arises. As a result of this force, the inertial sleeve moves away from the barrel, thereby compressing a thrust spring, runs into the longitudinal protrusion, resting against it with flange ledges, which in turn leads to raising the front ends of the petals due to the outer protrusions of the barrel and declutching the bolt from the barrel. The bolt is declutched from the barrel due to the separation of the front ends of the petals of the collet clamp or collet petals which work according to a two-arm level mechanism when crimping the arms of the collet petals with the longitudinal ledge. After that, the bolt also starts moving away from the barrel, while compressing the bolt spring. During this movement of the bolt and the inertial sleeve, the bolt is declutched from the barrel and the cartridge case is extracted.

The bolt moves until it approaches the fixed stop, and the inertial sleeve moves until it is clutched to the temporary-fixation ledge. Said clutching is aided by the action of the circular spring that lifts the rear parts of the petals. After reaching the extreme position at the fixed stop, the bolt begins to move towards the barrel under the action of the compressed bolt spring. During this movement, the small arms is loaded with a cartridge and the bolt is connected to the barrel. The connection of the bolt to the barrel is associated with their clutching which is carried out using the above-indicated lever-type mechanism. This mechanism is implemented when the inertial sleeve moves to the barrel clutching protrusion. This movement occurs due to the straightening of the spacer spring, in which:

- the inertial sleeve comes out of the temporary-fixation ledge when the rear ends of the collet petals are compressed with the longitudinal protrusion;
- the inertial sleeve compresses the rear ends (arms) of the petals along the longitudinal protrusion, thereby allowing the ends of the collet petals to overcome the outer protrusions of the bolt;
- the inertial sleeve slides along the petals towards the barrel clutching protrusions, thereby squeezing the petals and improving said clutching with the barrel;
- the inertial sleeve completes the clutching of the bolt to the barrel, reaching the extreme position on the collet petals.

As a result of the above-described actions, the small arms is brought into combat condition and is ready to fire. If there is no cut-off stroke of the trigger, the next shot occurs automatically.

Example 2

Similar to example 1, in the initial position, after the bolt is cocked, its position is as follows: the cartridge is in the cartridge chamber, the bolt is in the position in which it is clutched to the barrel (FIG. 1) fixed by the barrel clutching protrusion for the outer protrusion of the barrel, the inertial sleeve takes the extreme position at the barrel clutching protrusion, the spacer spring and the bolt spring are in an unstressed state, the striker is in its original position with the unstressed spring.

The initial position differs from that indicated in example 1 in that:

- the number of the collet petals arranged on top of the bolt body and framed by the inertial sleeve with the spacer spring is 24;
- on the inner side of these petals, there are projections for their fixation on the bolt in the amount of 3 per each petal in the direction of the bolt surface. These protrusions are arranged between the swing stop and the barrel clutching protrusion, closer to the latter.

In this case, a shot is carried out in the same way as in example 1. During the shot, the bolt-from-barrel declutching, the movement of the structural parts of the bolt, the extraction of the cartridge case and the bolt-to-barrel clutching again occur in the same way as in example 1. As a result of these actions, the small arms is brought into combat condition and ready to fire. If there is no cut-off stroke of the trigger, the next shot occurs automatically.

The above-given examples should not be construed as limiting the scope of the invention. Instead, variations, modifications and equivalents of the above-described examples are also possible within the scope of the claims.

The above-given description of the claimed invention, the disclosure of its essence and the examples allow one to conclude that the following purpose of the invention is implemented: "Longitudinally sliding bolt of small arms with the collet clutching mechanism on the barrel". This confirms the achievement of the technical result.

It also follows from the above-given description that the implementation of the claimed purpose is possible only if the whole set of essential features is implemented, which also confirms the task of implementing the invention has been technically solved.

The invention claimed is:

1. A longitudinally sliding bolt of small arms with a collet clutching mechanism on a barrel, wherein the bolt comprises collet clutching petals, a sleeve-like element controlling the collet clutching petals, a striker, a striker spring, a bolt spring having a stop;

wherein the collet clutching petals are arranged on top of a bolt body and framed by an inertial sleeve having a spacer spring;

wherein the collet clutching petals are provided in an amount of at least two, fastened with a circular spring shifted to a front side of the bolt from a central part of the collet clutching petals, and have protrusions at both ends which extend away from a bolt axis;

wherein the spacer spring and the inertial sleeve configured to longitudinally slide along the collet clutching petals are arranged between the protrusions sequentially in a row away from an end of the bolt;

wherein protrusions extending inwardly to engage with the barrel are provided on an inner side of the collet clutching petals towards the bolt axis in a front part of the collet clutching petals, wherein in the central part of the collet clutching petals, there are swing stops providing a lever-type mechanism for clutching and declutching the bolt to and from the barrel;

wherein protrusions for fixing the collet clutching petals on the bolt are arranged between the swing stops closer to the front part of the collet clutching petals;

wherein an outer surface of the collet clutching petals has a longitudinal protrusion having gradual bevels and shifted to a rear side of the bolt, the longitudinal protrusion being configured to control a mechanism for clutching and declutching the collet clutching petals on the barrel;

wherein the longitudinal protrusion on the rear side of the bolt has a ledge configured to temporarily fix the inertial sleeve in a rear position until a front part of the bolt comes into contact with a breech piece of the barrel when the bolt moves forward; and wherein matching elements configured to fix the swing stops and the protrusions for fixing the collet clutching petals are provided on a surface of the bolt.

2. The longitudinally sliding bolt of small arms according to claim 1, wherein the bolt comprises 2-24 collet clutching petals.

3. The longitudinally sliding bolt of small arms according to claim 1, wherein the inertial sleeve has a U-shaped configuration, when viewed in a section passing through an axis of the inertial sleeve.

4. The longitudinally sliding bolt of small arms according to claim 1, wherein the spacer spring is a helical compression spring.

5. The longitudinally sliding bolt of small arms according to claim 1, wherein the projections for fixing the collet clutching petals on the bolt are provided in the amount of 1 to 3 pieces on the inner side of each collet clutching petal.

* * * * *